US009869009B2

(12) United States Patent
Vartanov

(10) Patent No.: US 9,869,009 B2
(45) Date of Patent: Jan. 16, 2018

(54) HIGH STRENGTH LOW ALLOY STEEL AND METHOD OF MANUFACTURING

(71) Applicant: Gregory Vartanov, Oakville (CA)

(72) Inventor: Gregory Vartanov, Oakville (CA)

( * ) Notice: Subject to any disclaimer, the term of this patent is extended or adjusted under 35 U.S.C. 154(b) by 430 days.

(21) Appl. No.: 14/542,419

(22) Filed: Nov. 14, 2014

(65) Prior Publication Data

US 2015/0259771 A1 Sep. 17, 2015

Related U.S. Application Data

(60) Provisional application No. 61/962,706, filed on Nov. 15, 2013.

(51) Int. Cl.

| | |
|---|---|
| ***C23C 8/26*** | (2006.01) |
| ***C22C 38/50*** | (2006.01) |
| ***C21D 1/18*** | (2006.01) |
| ***C23C 8/22*** | (2006.01) |
| ***C22C 38/46*** | (2006.01) |

(Continued)

(52) U.S. Cl.

CPC ..... *C22C 38/50* (2013.01); *C21D 1/18* (2013.01); *C21D 1/22* (2013.01); *C21D 1/25* (2013.01); *C21D 1/673* (2013.01); *C21D 7/13* (2013.01); *C21D 9/28* (2013.01); *C21D 9/30* (2013.01); *C21D 9/32* (2013.01); *C22C 38/02* (2013.01); *C22C 38/20* (2013.01); *C22C 38/24* (2013.01); *C22C 38/28* (2013.01); *C22C 38/42* (2013.01); *C22C 38/44* (2013.01); *C22C 38/46* (2013.01); *C23C 8/22* (2013.01); *C21D 1/28* (2013.01); *C21D 1/30* (2013.01); *C21D 2211/001* (2013.01); *C21D 2211/003* (2013.01);

(Continued)

(58) Field of Classification Search

CPC ..... C22C 38/50; C22C 38/28; C22C 38/20; C22C 38/02; C22C 38/24; C22C 38/42; C22C 38/44; C22C 38/46; C21D 7/13; C21D 1/673; C21D 1/25; C21D 1/22; C21D 9/32; C21D 9/30; C21D 9/28; C21D 1/18; C21D 2211/008; C21D 2211/001; C21D 2211/003; C21D 2211/004; C21D 2211/005; C21D 1/30; C21D 1/28; C23C 8/22

USPC ..... 420/8–129

See application file for complete search history.

(56) References Cited

U.S. PATENT DOCUMENTS 5,454,883 A 10/1995 Yoshie
5,904,787 A * 5/1999 Matsumoto ..... B21C 37/04 148/333

(Continued)

FOREIGN PATENT DOCUMENTS

GB 201421047 * 1/2015 ..... C21D 9/40
JP 5610102 B2 * 10/2014 ..... C21D 8/0226

(Continued)

*Primary Examiner* — Kiley Stoner

(57) ABSTRACT

The present invention relates to a wrought, quenched and tempered, fine-grained, with deep hardenability, high strength and low alloy steel having a sum of the alloying elements: nickel, molybdenum, tungsten, vanadium, titanium, and niobium in weight percent 1.0% to 1.60%. The air melted and hot forged steel of the present invention has hardness of HRC 55, an ultimate tensile strength of 300 ksi, a yield strength of 257 ksi, a total elongation of 9%, a reduction of area of 32%, and Charpy v-notch impact toughness energy of 15 ft-lb after normalizing, gas quenching, and tempering at 450° F.

3 Claims, 2 Drawing Sheets

| Alloying Element, weight % | 1st embodiment | 2nd embodiment | 3rd embodiment |
|---|---|---|---|
| C | 0.18% to 0.55% | 0.18% to 0.55% | 0.18% to 0.55% |
| N | 0.001% to 0.05% | 0.001% to 0.05% | 0.001% to 0.05% |
| Mn | 2.0% max (excludes 0%) | 2.0% max (excludes 0%) | 2.0% max (excludes 0%) |
| Cu | 1.5% max | 1.5% max | 1.5% max |
| Ni | 1.0% max (excludes 0%) | - | - |
| Cr | 3.0% max (excludes 0%) | 3.0% max (excludes 0%) | 3.0% max (excludes 0%) |
| Mo+W | 0.20% max (excludes 0%) | - | - |
| V | 0.30% max (excludes 0%) | 0.30% max (excludes 0%) | - |
| Ti+Nb | 0.1% max (excludes 0%) | 0.1% max (excludes 0%) | 0.1% max (excludes 0%) |
| Si | 2.0% max (excludes 0%) | 2.0% max (excludes 0%) | 2.0% max (excludes 0%) |
| Al | 0.0% to 0.2% | 0.0% to 0.2% | 0.0% to 0.2% |
| Ca | 0.001% to 0.05% | 0.001% to 0.05% | 0.001% to 0.05% |
| P | 0.035 max | 0.035 max | 0.035 max |
| S | 0.04 max | 0.04 max | 0.04 max |
| Fe | remainder | remainder | remainder |

Alloying compositions of the first, second, and third embodiments of the New Steel

(51) Int. Cl.

| | |
|---|---|
| ***C22C 38/44*** | (2006.01) |
| ***C22C 38/42*** | (2006.01) |
| ***C22C 38/28*** | (2006.01) |
| ***C22C 38/24*** | (2006.01) |
| ***C22C 38/20*** | (2006.01) |
| ***C22C 38/02*** | (2006.01) |
| ***C21D 7/13*** | (2006.01) |
| ***C21D 9/28*** | (2006.01) |
| ***C21D 9/30*** | (2006.01) |
| ***C21D 9/32*** | (2006.01) |
| ***C21D 1/22*** | (2006.01) |
| ***C21D 1/25*** | (2006.01) |
| ***C21D 1/673*** | (2006.01) |
| *C21D 1/28* | (2006.01) |
| *C21D 1/30* | (2006.01) |

(52) U.S. Cl.
CPC .. *C21D 2211/004* (2013.01); *C21D 2211/005* (2013.01); *C21D 2211/008* (2013.01)

(56) References Cited

U.S. PATENT DOCUMENTS

| | | | | |
|---|---|---|---|---|
| 7,067,019 | B1 | 6/2006 | Fedchun | |
| 7,537,727 | B2 | 5/2009 | Dilmor | |
| 8,137,483 | B2 | 4/2012 | Fedchun | |
| 8,361,247 | B2 * | 1/2013 | Vartanov | C21D 1/25 148/325 |
| 8,414,713 | B2 | 4/2013 | Vartanov | |
| 2005/0034790 | A1 * | 2/2005 | Amaya | C22C 38/001 148/325 |
| 2006/0196583 | A1 | 9/2006 | Hayashi | |
| 2009/0291014 | A1 * | 11/2009 | Vartanov | C21D 6/004 420/91 |
| 2013/0276940 | A1 * | 10/2013 | Nakajima | C21D 8/0226 148/602 |
| 2013/0284319 | A1 | 10/2013 | Novotny | |
| 2014/0338801 | A1 * | 11/2014 | Nakajima | C22C 38/001 148/602 |
| 2015/0191807 | A1 * | 7/2015 | Hanlon | C21D 8/0426 148/541 |
| 2015/0218708 | A1 * | 8/2015 | Maruyama | C21D 9/46 428/684 |
| 2016/0168670 | A1 * | 6/2016 | Cheney | C22C 38/36 420/64 |

FOREIGN PATENT DOCUMENTS

| | | | | |
|---|---|---|---|---|
| KR | 2012063199 | A * | 6/2012 | |
| WO | WO 2008084108 | A1 * | 7/2008 | |
| WO | WO 2012156428 | A1 * | 11/2012 | C21D 1/19 |
| WO | WO 2013024860 | A1 * | 2/2013 | |

* cited by examiner

| Alloying Element, weight % | 1st embodiment | 2nd embodiment | 3rd embodiment |
|---|---|---|---|
| C | 0.18% to 0.55% | 0.18% to 0.55% | 0.18% to 0.55% |
| N | 0.001% to 0.05% | 0.001% to 0.05% | 0.001% to 0.05% |
| Mn | 2.0% max (excludes 0%) | 2.0% max (excludes 0%) | 2.0% max (excludes 0%) |
| Cu | 1.5% max | 1.5% max | 1.5% max |
| Ni | 1.0% max (excludes 0%) | - | - |
| Cr | 3.0% max (excludes 0%) | 3.0% max (excludes 0%) | 3.0% max (excludes 0%) |
| Mo+W | 0.20% max (excludes 0%) | - | - |
| V | 0.30% max (excludes 0%) | 0.30% max (excludes 0%) | - |
| Ti+Nb | 0.1% max (excludes 0%) | 0.1% max (excludes 0%) | 0.1% max (excludes 0%) |
| Si | 2.0% max (excludes 0%) | 2.0% max (excludes 0%) | 2.0% max (excludes 0%) |
| Al | 0.0% to 0.2% | 0.0% to 0.2% | 0.0% to 0.2% |
| Ca | 0.001% to 0.05% | 0.001% to 0.05% | 0.001% to 0.05% |
| P | 0.035 max | 0.035 max | 0.035 max |
| S | 0.04 max | 0.04 max | 0.04 max |
| Fe | remainder | remainder | remainder |

Fig.1 Alloying compositions of the first, second, and third embodiments of the New Steel

| | C, wt.% | HRC | UTS, ksi | YS, ksi | El, % | RA, % | CVN, ft-lb |
|---|---|---|---|---|---|---|---|
| Embodiment #1 | 0.20 | 46 | 220 | 175 | 15 | 50 | 32 |
| | 0.30 | 50 | 255 | 210 | 13 | 44 | 26 |
| | 0.40 | 53 | 282 | 238 | 11 | 38 | 20 |
| | 0.50 | 57 | 320 | 260 | 8 | 30 | 12 |
| | 0.55 | 59 | 340 | 270 | 7 | 22 | 8 |
| Embodiment #2 | 0.20 | 46 | 220 | 170 | 14 | 44 | 26 |
| | 0.30 | 50 | 252 | 206 | 12 | 40 | 23 |
| | 0.40 | 53 | 280 | 230 | 10 | 36 | 18 |
| | 0.50 | 57 | 320 | 255 | 8 | 24 | 10 |
| | 0.55 | 59 | 340 | 265 | 7 | 20 | 6 |
| Embodiment #3 | 0.20 | 45 | 215 | 160 | 10 | 38 | 22 |
| | 0.30 | 49 | 250 | 200 | 9 | 34 | 20 |
| | 0.40 | 52 | 270 | 220 | 8 | 30 | 14 |
| | 0.50 | 56 | 310 | 240 | 6 | 22 | 10 |
| | 0.55 | 58 | 330 | 260 | 5 | 14 | 4 |

Fig. 2 Mechanical properties of the first, second, and third embodiments of the New Steel

HIGH STRENGTH LOW ALLOY STEEL AND METHOD OF MANUFACTURING

RELATED APPLICATION

This application claims the benefit of priority to U.S. Provisional Patent Application Ser. No. 61/962,706, entitled "High Strength Low Alloy Steel and Method of Manufacturing", filed Nov. 15, 2013, which is hereby incorporated by reference in its entirety.

FIELD OF THE INVENTION

This invention relates to a high strength low alloy steel for the automotive and other industries and method of manufacturing.

BACKGROUND

Energy saving and safety have become the most important issues for the auto-making industry. Weight reduction is most effective way to achieve this goal, which leads to the fast development and application of high strength steels for the automotive industry.

The well-known SAE 8620, 8625, and 8630 carburized steels are commonly used for manufacturing car components which require increased surface hardness and high contact fatigue, including shafts, camshafts, gears, fasteners, chain pins, spindles, cams, worm pairs, etc. High strength low alloy serious steel HSLA 60-100 commonly used for manufacturing wide range of car components wherein moderate strength and good weldability are required.

Several wrought high strength alloy steels potentially can be implemented in the automotive industry. High strength of more than 280 ksi and yield strength of more than 220 ksi in the quenched and tempered condition make them as the potential candidates for automotive structural and safety components.

High strength low alloy steel of the present invention is a new generation of high strength composition for the auto-making industry. Tensile strength of 110 ksi to 130 ksi and 210 ksi to 340 ksi, elongation of 20% to 30% and 7% to 12%, and Charpy impact toughness energy of 30 ft-lb to 40 ft-lb and 10 ft-lb to 20 ft-lb in the annealed and hardened conditions make the high strength low alloy steel of the present invention attractive for the automotive structural, safety, power-train, and suspension components.

SUMMARY OF THE INVENTION

The present invention relates to a quenched and tempered, fine-grained, with deep hardenability, high strength and low alloy steel ("New Steel") with the following features:

ASTM grain size number 6 to 8

Ideal critical diameter from 2.5 inch to 21.5 inch

Ultimate tensile strength from 215 ksi to 340 ksi.

The first embodiment of the New Steel is a low alloy composition having in weight percentage nickel of 1.0% maximum, a sum of molybdenum and tungsten of 0.20% maximum, vanadium of 0.30% maximum, and a sum of titanium and niobium of 0.10% maximum.

The second embodiment of the New Steel is the nickel, molybdenum, and tungsten free low alloy composition having in weight percentage vanadium of 0.30% maximum, and a sum of titanium and niobium of 0.10% maximum.

The third embodiment of the New Steel is the nickel, molybdenum, tungsten, and vanadium free low alloy composition having in weight percentage a sum of titanium and niobium of 0.10% maximum.

Alloying composition of the New Steel differs from the high strength alloy steels of the following patents and patents applications:

- U.S. patent application Ser. No. 12/488,112, Ser. No. 13/016,606, Ser. No. 13/457,631, Ser. No. 13/645,596, and Ser. No. 13/646,988 by lower concentrations of nickel, molybdenum, and vanadium and by presence of titanium and niobium
- U.S. Pat. No. 7,067,019 by lower concentration of nickel and titanium and by presence of niobium
- U.S. Pat. No. 8,414,713 by lower concentration of molybdenum and tungsten
- U.S. Pat. No. 7,537,727 by lower concentration of tungsten and by presence of titanium and niobium
- U.S. Pat. No. 8,137,483 by lower concentration of titanium and niobium and by presence of tungsten
- U.S. Pat. No. 5,454,883 by absence of boron and cobalt
- U.S. patent application Ser. No. 10/556,298 by absence of boron
- EP2126150 patent by lower concentration of aluminum and nickel.

BRIEF DESCRIPTION OF THE DRAWINGS

FIG. 1 shows the alloying compositions of the three embodiments of the New Steel.

FIG. 2 shows mechanical properties of the New Steel: the first embodiment (#1) with carbon concentration in weight percentage from 0.20% to 0.55% and the sum of expensive alloying elements nickel, molybdenum, tungsten, vanadium, titanium, and niobium in weight percentage from 1.40% to 1.60%; the second embodiment (#2) with carbon concentration in weight percentage from 0.20% to 0.55% and the sum of expensive alloying elements vanadium, titanium, and niobium in weight percentage from 0.30% to 0.40%; and third embodiments (#3) with carbon concentration in weight percentage from 0.20% to 0.55% and the sum of expensive alloying elements titanium and niobium in weight percentage from 0.05% to 0.10%. Ingots of the all embodiments were subjected to: hot rolling to 2.0 inch diameter bars; normalizing at 1600° F. to 1750° F. for 1 hr and air cooling and then stress relieving at 1225° F. to 1275° F. for 5 to 6 hrs and air cooling; austenizing at 1550° F. to 1700° F., oil quenching, and tempering at 400° F. to 450° F. for 3 to 4 hrs and air cooling. There are the following abbreviations in the FIG. 2: C is a carbon concentration in wt. %, HRC is a hardness Rockwell scale C, UTS is a ultimate tensile strength in ksi, YS is a yield strength in ksi, El is a total elongation in %, RA is a reduction of area in %, and CVN is Charpy v-notch impact toughness energy in ft-lb.

DETAILED DESCRIPTION OF THE INVENTION

There are the following key elements of the New Steel: austenite forming manganese, copper, and nickel in the first embodiment and manganese and copper in the second and third embodiments; ferrite forming chromium, silicon; strong carbide forming element vanadium, titanium and niobium, molybdenum and tungsten in the first embodiment; vanadium, titanium and niobium in the second embodiment; and titanium and niobium in the third embodiment.

Carbides are critical in formation of the New Steel microstructure and properties.

The primary titanium carbide (TiC) and niobium carbide (NbC) are precipitated after solidification, and vanadium carbide (VC) is precipitated after hot working. One role of the primary carbides is to retard grain growth during austenitizing that leads to strength improvement. The fine dispersed vanadium carbide (VC) is precipitated during medium or high temperature tempering that promotes second hardening.

Molybdenum carbides ($Mo_2C$/MoC) and tungsten carbides ($W_2C$/WC) are precipitated during or after low temperature austenizing or high temperature annealing. There are no hardening by precipitation of molybdenum and tungsten carbides due to low concentrations of molybdenum and tungsten.

Complex cementite $(Fe,M)_3C$, wherein M is one or more elements of V, Mo, W, Cr and Si is precipitated after quenching and high temperature tempering. Complex carbides can be precipitated after quenching and high temperature tempering as well.

The strong carbide forming element of Ti, Nb, V, W, Mo and Cr can form nitrides in the presence of N in the New Steel. An effect of the nitrides on the New Steel is similar to the primary carbides.

Solid solution of New Steel is formed by two groups of elements. The first group is the austenite forming Mn, Cu, and Ni and the second group is ferrite forming elements Cr and Si. Presence of V in the solid solution increases toughness and presence of Mo and W increases strength and hardenability of the New Steel.

The New Steel has the following concentrations of the alloying elements in weight percent:

Carbon (C) concentration 0.18% to 0.55%

Nitrogen (N) concentration 0.001% to 0.05%

Manganese (Mn) concentration 2.0% maximum (excludes 0%)

Copper (Cu) concentration 1.5% maximum.

Nickel (Ni) concentration 1.0% maximum (excludes 0%) in the first embodiment and 0.0% in the second and third embodiments Chromium (Cr) concentration 3.0% maximum (excludes 0%)

one or two elements of molybdenum (Mo) and tungsten (W) in the New Steel, wherein a sum of molybdenum (Mo) concentration and tungsten (W) concentration 0.20% maximum (excludes 0%) in the first embodiment and 0.0% in the second and third embodiments Vanadium (V) concentration 0.30% maximum (excludes 0%) in the first and second embodiments and 0.0% in the third embodiments one or two elements of titanium (Ti) and niobium (Nb) in the New Steel, wherein a sum of titanium (Ti) concentration and niobium (Nb) concentration 0.1% maximum (excludes 0%)

Silicon (Si) concentration 2.0% maximum (excludes 0%)

Aluminum (Al) concentration 0.0% to 0.2%

Calcium (Ca) concentration 0.001% to 0.05%

Phosphorus (P) concentration 0.035% maximum

Sulphur (S) concentration 0.04% maximum

Balance is iron (Fe) and incidental impurities.

It is obvious that the concentration 0.0% of some aforementioned elements means their presence is trace or incidental. Concentrations of the trace or incidental elements depend on the methods of melting, annealing, hot working, and heat treatment of the New Steel.

The New steel is a low alloy composition having: a sum of the alloying elements manganese, copper, chromium, and silicon in weight percent of 6.0% maximum preferably of 2.0% to 6.0% in the all three embodiments; a sum of the expensive alloying elements nickel, molybdenum, tungsten, vanadium, titanium, and niobium in weight percent of 1.60% maximum preferably of 1.0% to 1.60% in the first embodiment; a sum of vanadium, titanium, and niobium in weight percent of 0.40% maximum preferably of 0.10% to 0.40% in the second embodiment; a sum of titanium and niobium in weight percent of 0.10% maximum preferably of 0.04% to 0.10% in the third embodiment.

A quantitative measure of hardenability of the New Steel is expressed by its ideal critical diameter. The ideal critical diameters of the embodiments of the New Steel having ASTM grain size number 7 (average grain diameter of 32 microns) are as follows: 5 inch to 21 inch for the first embodiment; 3 inch to 10 inch for the second embodiment; and 2.5 inch to 8 inch for the third embodiment.

The method of manufacturing of the New Steel of the present invention includes: melting, casting, annealing, hot working, and heat treating.

The New steel is melted by conventional air or vacuum melting method.

The method of casting consists of conventional casting of ingots or continuous casting.

Annealing of the New Steel includes: homogenizing annealing to uniform alloying composition and microstructure before hot working; high temperature annealing (full annealing) by heating to higher than the upper critical temperature ($A_{C3}$) and slowly cooling to supply softening and ductility; process annealing that is a similar to full annealing, but with faster cooling rate to produce a uniform microstructure; soft annealing increases ductility and uniforms microstructure prior to machining or cold working to avoid fracturing; stress relief annealing reduces residual stresses after hot working or sever machining; normalizing is used to refine grain structure and make it more uniform.

Hot working of the New Steel includes rolling, forging, extrusion, and piercing. Hot rolling includes: rolling the flat products such as sheets and plates; rolling the bar products with different cross section shapes. Hot forging includes open die forging, impression die forging, and flashless forging. Hot extrusion includes direct and indirect extrusion. Hot piercing includes rotary piercing for forming seamless tubes and pipes.

An important metal-forming process for manufacturing automotive and truck components is cold stamping of hot rolled sheets of the New Steel. After hot rolling and further full annealing or hot rolling and further normalizing and stress relief, the New Steel can be subjected to cold stamping. Hot rolled sheets can be subjected to warm or hot stamping as well.

Another important metal-forming process of manufacturing automotive coil springs is cold drawing wires from hot rolled and further full annealed bars.

Other conventional cold working processes such as rolling, extrusion, blanking, piercing and other are applicable for the New Steel after hot working and further full annealing.

The New Steel can be subjected to an additional normalizing or normalizing and stress relief before heat treatment in order to refine grain structure and improve mechanical properties.

Heat treatment of the New Steel consists of the following, but not limited to, conventional methods consisting of austenizing, quenching, and tempering.

Austenizing (Solution Treatment)

Austenizing of the New Steel is conducted by heating to temperature higher than the upper critical temperature ($A_{C3}$)

and holding for sufficient time to complete austenite transformation. There are three types of austenizing that depend on their temperatures: low temperature austenizing from 1500° F. to 1575° F. supplies the ASTM grain size number 7-8 (average grain diameter of 22 microns to 32 microns); medium temperature austenizing from 1575° F. to 1675° F. supplies the ASTM grain size number 7 (average grain diameter of 32 microns); and high temperature austenizing from 1675° F. to 1875° F. supplies the ASTM grain size number 6-7 (average grain diameter of 32 to 44 microns).

Quenching

Quenching of the New Steel includes cooling with sufficient rate to form martensite or bainite structure and it can be conducted by salt bath, forced gas, liquid quenchants such as salt brines, water, polymers, and oils. Quenching of the low carbon compositions (carbon weight percentage of 0.18% to 0.30%) can be conducted in salt brine and water. Quenching of the medium carbon compositions (carbon weight percentage of 0.30% to 0.45%) can be conducted in water, polymer, gas, and oil. Quenching of the high carbon compositions (carbon weight percentage of 0.45% to 0.55%) can be conducted in polymer, oil, and gas. All compositions can be quenched in salt bath.

Tempering

Low temperature tempering consists of heating to temperature below the martensite start temperature ($M_S$), preferably from 350° F. to 600° F. and holding for 1 hr to 5 hrs and air cooling. The low temperature tempering relieves internal stresses that lead to reducing hardness and increasing ductility and toughness for all embodiments.

Medium temperature tempering is conducted at temperatures above the martensite start temperature ($M_S$) and below temperature of formation of the ferrite microstructure preferably from 600° F. to 950° F. for 1 hr to 8 hrs and air cooling or cooling in liquid medium. Medium temperature tempering promote partial decomposition of martensite and precipitation of fine vanadium carbides (VC) and complex carbides for the first and second embodiments and partial decomposition of martensite for the third embodiments that leads to increasing hardness and strength, reducing ductility and toughness for all embodiments.

High temperature tempering is conducted at temperatures upper than the temperature of formation of the ferrite microstructure and below than the lower critical temperature ($A_{C1}$) preferably from 950° F. to 1200° F. for 1 hr to 8 hrs and air cooling or cooling in liquid medium. The high temperature tempering promotes full decomposition of martensite, formation of ferrite microstructure, and precipitation of complex cementite $(Fe, M)_3C$, wherein M is one or more elements of V, Mo, W, Cr and Si and complex carbides. This tempering leads to reducing hardness and strength, increasing ductility and toughness for all embodiments.

Microstructure of the first and second embodiments comprise: small packets of martensite laths, retained austenite, and fine titanium carbides (TiC) or/and fine niobium carbides (NbC), fine vanadium carbides (VC) after low temperature tempering; small martensite laths, ferrite, and fine titanium carbides (TiC) or/and fine niobium carbides (NbC), fine vanadium carbides (VC) after medium temperature tempering; ferrite, complex cementite $(Fe, M)_3C$ and complex carbides, and fine titanium carbides (TiC) or/and fine niobium carbides (NbC), fine vanadium carbides (VC) after high temperature tempering.

Microstructure of the third embodiment comprises: small packets of martensite laths, retained austenite, and fine titanium carbides (TiC) or/and fine niobium carbides (NbC) after low temperature tempering; small packets of martensite laths, ferrite, and fine titanium carbides (TiC) or/and fine niobium carbides (NbC) after medium temperature tempering; ferrite, complex cementite $(Fe, M)_3C$ and complex carbides, and fine titanium carbides (TiC) or/and fine niobium carbides (NbC) after high temperature tempering.

Heat treatment can be conducted in protective environment to avoid decarburization and oxidation. Martempering and austempering can be applied to improve mechanical properties. Double quenching and tempering can be conducted to improve properties.

The New Steel with carbon concentration in weigh percentage of 0.18% to 0.30% has case depth about 0.04 inch to about 0.06 inch, surface hardness HRC about 59 to about 62, and core hardness HRC about 41 to about 43 after carburizing by conventional methods.

The New Steel with carbon concentration in weigh percentage of 0.30% to 0.45% is a deep nitriding composition that is perfect for high precision components. After nitriding by conventional methods, the New Steel has case depth about 0.02 inch to about 0.03 inch, surface hardness HRC about 61 to about 63, and core hardness HRC about 45 to about 46.

Mechanical properties of the New Steel depend on: carbon and alloying elements concentrations; type of hot or cold working; modes of annealing; and heat treatment. The first embodiments of the New steel has an ultimate tensile strength of 220 ksi to 340 ksi, a yield strength of 175 ksi to 270 ksi, a total elongation of 7% to 15%, a reduction of area of 22% to 50%, Charpy v-notch impact toughness energy of 8 ft-lb to 32 ft-lb. The second embodiment has an ultimate tensile strength of 220 ksi to 340 ksi, a yield strength of 170 ksi to 265 ksi, a total elongation of 7% to 14%, a reduction of area of 20% to 44%, Charpy v-notch impact toughness energy of 6 ft-lb to 26 ft-lb. The third embodiment has an ultimate tensile strength of 215 ksi to 330 ksi, a yield strength of 160 ksi to 260 ksi, a total elongation of 5% to 10%, a reduction of area of 14% to 38%, Charpy v-notch impact toughness energy of 4 ft-lb to 22 ft-lb.

The present invention is explained and illustrated more specifically by the following non-limiting examples.

EXAMPLE 1

The New Steel with carbon concentration in weight percentage of 0.18% to 0.30% is applicable for carburizing. It can be utilized for, but not limited to, applications such as automotive shafts, camshafts, gears, fasteners, chain pins, spindles, cams, worm pairs, and other components that required high surface hardness, high contact fatigue, and moderate core hardness.

Table 1 shows the alloying compositions of three ingots of the first ($1^{st}$), second ($2^{nd}$) and third ($3^{rd}$) embodiments of the carburized New Steel; balance Fe and accidental impurities

TABLE 1

| | C | Ni | Mn | Cu | Si | Cr | Mo | V | Ti | P | S |
|---|---|---|---|---|---|---|---|---|---|---|---|
| 1st | 0.21 | 1.0 | 0.75 | 0.50 | 0.8 | 1.25 | 0.10 | 0.20 | 0.05 | 0.015 | 0.025 |
| 2nd | 0.21 | — | 0.75 | 0.50 | 0.8 | 1.25 | — | 0.20 | 0.05 | 0.015 | 0.025 |
| 3rd | 0.21 | — | 0.75 | 0.50 | 0.8 | 1.25 | — | — | 0.05 | 0.015 | 0.025 |

The compositions of the Table1 have the following ideal critical diameters: the first embodiments of 6.46 inch; the second embodiment of 3.65 inch; and the third embodiment of 2.70 inch.

The ingots of 6 inch diameter and 120-130 lbs weight were air melted in an induction furnace, and then the ingots were homogenize annealed at 2150 F for 6 hrs and air cooled. The ingots were heated to 2100° F. and hot rolled until 1850° F. to 2.0 inch bars, and then air cooled.

One part of the bars was normalized at 1650° F. for 1 hr and air cooled (N condition); the bars had hardness of HRC 41-42. Another part of the bars was annealed in a furnace at 1600° F. for 6 hrs, furnace cooled to 600° F., and air cooled (A condition); the bars had hardness of HB 200-210 (HRC 18-19).

The bars of the N condition were subjected to heat treatment and carburizing by the following methods: austenizing at 1700° F. for 1 hrs, oil quenching and air cooling, tempering at 450° F. for 3 hrs and air cooling (QT condition); carburizing at 1750° F. for 8 hrs, oil quenching and air cooling, tempering at 450° F. for 3 hrs and air cooling (C condition). After the carburizing, the New Steel has 0.06 inch case depth.

Microstructure of the New steel of the first embodiment of the QT condition comprises: small packets of martensite laths, fine titanium carbides (TiC), fine vanadium carbides (VC), and retained austenite in weight percent of 1% to 3%. The first embodiment has the ASTM grain size number 7 (average grain diameter of 32 microns).

Microstructure of the New steel of the second embodiment of the QT condition comprises: small packets of martensite laths, fine titanium carbides TiC, fine vanadium carbides VC, and retained austenite in weight percent of 1% maximum. The second embodiment has the ASTM grain size number 7 (average grain diameter of 32 microns).

Microstructure of the New steel of the third embodiment of the QT condition comprises: small packets of martensite laths, fine titanium carbides TiC, and retained austenite in weight percent of 1% maximum. The third embodiment has the ASTM grain size number 7 (average grain diameter of 32 microns).

ASTM standard tensile specimens were machined from 0.5 radiuses of the bars and then heat treated or carburized and heat treated by conventional methods.

Table 2 shows results of the ASTM standard tensile tests at room temperature in the A, N, QT, and C conditions.

TABLE 2

| | HRC, surface/core | | | UTS, ksi | | | YS, ksi | | | El, % | | | RA, % | | |
|---|---|---|---|---|---|---|---|---|---|---|---|---|---|---|---|
| | 1st | 2nd | 3rd | 1st | 2nd | 3rd | 1st | 2nd | 3rd | 1st | 2nd | 3rd | 1st | 2nd | 3rd |
| A | — | — | — | 85 | 86 | 84 | 62 | 62 | 60 | 30 | 30 | 28 | 60 | 59 | 58 |
| N | 19 | 19 | 18 | 116 | 114 | 108 | 68 | 63 | 60 | 21 | 20 | 15 | 52 | 50 | 44 |
| QT | 46 | 46 | 45 | 220 | 220 | 215 | 170 | 165 | 160 | 15 | 14 | 10 | 48 | 44 | 38 |
| C | 59/45 | 59/45 | 58/44 | 215 | 215 | 210 | 160 | 155 | 150 | 13 | 11 | 8 | 50 | 45 | 38 |

The New Steel can be welded by the conventional methods in the A and N conditions.

EXAMPLE 2

The New Steel with the medium carbon weight percentage of 0.30% to 0.45% is applicable for car body structure and safety system components such as anti-crash rods, bars, tubes, gussets, and plates. Another application of the New Steel is suspensions of trucks.

Table 1 shows the alloying compositions of three ingots of the first, second, and third embodiments of the New Steel; balance Fe and accidental impurities.

TABLE 1

| | C | Ni | Mn | Cu | Si | Cr | Mo | V | Ti | P | S |
|---|---|---|---|---|---|---|---|---|---|---|---|
| 1st | 0.39 | 1.0 | 0.6 | 0.50 | 1.0 | 1.50 | 0.1 | 0.20 | 0.06 | 0.02 | 0.025 |
| 2nd | 0.39 | — | 0.6 | 0.50 | 1.0 | 1.50 | — | 0.20 | 0.06 | 0.02 | 0.025 |
| 3rd | 0.39 | — | 0.6 | 0.50 | 1.0 | 1.50 | — | — | 0.06 | 0.02 | 0.025 |

The compositions of the Table1 have the following ideal diameters: the first embodiments of 12.91 inch; the second embodiment of 7.28 inch; and the third embodiment 5.41 inch.

The ingots of 4 inch×8 inch in cross section and 120-140 lbs weight were air melted in an induction furnace, and then the ingots were homogenize annealed at 2150 F for 6 hrs and air cooled. The ingots were heated to 2100° F. and hot rolled until 1850° F. by 5 steps to 0.08 inch thickness and 30" width sheets, and then air cooled.

One part of the sheets was normalized at 1650° F. for 1 hr and air cooled and then the sheets were subjected to stress relief at 1250° F. for 5 hrs and air cooled (N+SR condition); the sheets had a hardness of HRC 30-32. Another part of the sheets was annealed in a furnace at 1600° F. for 6 hrs, furnace cooled to 600° F., and air cooled (A condition); the sheets have hardness of HB 210-220 (HRC 19-20). The remained part of the sheets was normalized at 1650° F. for 1 hr and air cooled (N condition); the sheets have hardness of HRC 40-42.

The sheets of the N+SR condition were heat treated by: austenizing at 1550° F. for 0.5 hr, water quenching, and tempering at 450° F. for 3 hrs and air cooled (QT condition).

The sheets of the A condition were cold rolled to 0.06 inch thickness sheets (CR condition).

Microstructure of the New steel of the first embodiment of the QT condition comprises: small packets of martensite laths, fine titanium carbides (TiC), fine vanadium carbides (VC), and retained austenite in weight percent of 1% to 3%. The ASTM grain size number is 8 (average grain diameter of 22 microns).

Microstructure of the New steel of the second embodiment of the QT condition comprises of: small packets of martensite laths, fine titanium carbides (TiC), fine vanadium carbides (VC), and retained austenite in weight percent of 1% maximum. The ASTM grain size number is 8 (average grain diameter of 22 microns).

Microstructure of the New steel of the third embodiment of the QT condition comprises: small packets of martensite laths, fine titanium carbides (TiC), and retained austenite in weight percent of 1% maximum. The ASTM grain size number is 7 (average grain diameter of 32 microns).

Table 2 shows the room temperature tensile test results in the longitudinal direction of the ASTM standard specimens in the A, N+SR, N, QT, and CR conditions.

TABLE 2

| | HRC | | | UTS, ksi | | | YS, ksi | | | El, % | | |
|---|---|---|---|---|---|---|---|---|---|---|---|---|
| | 1st | 2nd | 3rd | 1st | 2nd | 3rd | 1st | 2nd | 3rd | 1st | 2nd | 3rd |
| A | 19 | 18 | 18 | 104 | 100 | 100 | 72 | 70 | 70 | 26 | 25 | 24 |
| N + SR | 31 | 30 | 30 | 142 | 134 | 136 | 102 | 100 | 98 | 12 | 10 | 9 |
| N | 43 | 41 | 41 | 204 | 190 | 188 | 152 | 146 | 142 | 9 | 8 | 6 |
| QT | 53 | 53 | 52 | 282 | 280 | 270 | 238 | 230 | 220 | 12 | 11 | 8 |
| CR | 40 | 38 | 36 | 180 | 170 | 160 | 140 | 135 | 130 | 12 | 10 | 8 |

Table 2 shows that New Steel in the full annealed A condition has hardness and ductility that are applicable for cold stamping and fabrication such as cutting, bending, and machining of car body safety and structure components.

Low hardness of A condition and high hardness of N condition and QT condition allows utilizing the following method of making car body structure and safety system components: cold stamping, cutting, bending, and machining the components in the annealed condition; hardening the components by normalizing to obtain hardness of HRC 43; or hardening the components by water quenching and tempering to obtain hardness of HRC 53.

The New Steel can be welded by the conventional methods in A and N conditions.

EXAMPLE 3

The New Steel with a carbon concentration in weight percentage from 0.45% to 0.55% is applicable for coil and leaf springs of automotive suspensions.

Table 1 shows the alloying compositions of the leaf spring steel of the composition #1 of the first embodiment and the coil spring steel of the composition #2 of the second embodiment in weight percentage.

TABLE 1

| | C | Ni | Mn | Cu | Si | Cr | Mo | V | Ti | P | S |
|---|---|---|---|---|---|---|---|---|---|---|---|
| #1 | 0.45 | 1.0 | 0.6 | 0.50 | 1.0 | 1.50 | 0.1 | 0.20 | 0.05 | 0.02 | 0.025 |
| #2 | 0.50 | — | 0.6 | 0.50 | 1.8 | 2.0 | — | 0.20 | 0.05 | 0.02 | 0.025 |

*balance Fe and accidental impurities

The compositions of the Table1 have ideal critical diameters: #1 of 13.72 inch; and #2 of 13.75 inch.

An ingot of the composition #1 of 3 inch×6 inch in cross section and 90 lbs weight were air melted in an induction furnace, and then the ingot was homogenize annealed at 2150 F for 6 hrs and air cooled. The ingot was heated to 2100° F. and hot rolled until 1850° F. to 0.20 inch thickness and 15 inch width strip, and then the strip was air cooled.

The strips were normalized at 1600° F. for 1 hr and air cooled. The normalized strips were austenized at 1550° F. for 0.5 hr, oil quenched, and tempering at 450° F. and 1000° F. for 3 hrs and air cooled (QT450 and QT1000 conditions).

Ingot of the composition #2 of 6.0" in diameter and 100 lbs weight was air melted, homogenize annealed at 2150° F. for 6 hrs, hot rolled at 1850° F. minimum and 2200° F. maximum into the bars of 1.5 inch diameter.

One part of the bars was annealed at 1550° F. for 6 hrs, furnace cooled to 600° F., and air cooled. Further, the annealed bars were cold drawing to 0.75 inch wires, and finally the wires were stress relieved at 1200° F. for 4 hrs and air cooled (CD condition).

The remained part of the bars was normalized at 1600° F. for 1 hr and air cooled. The normalized strips were austenized at 1550° F. for 0.5 hr, oil quenched, and tempering at 450° F. for 3 hrs and air cooled (QT condition).

Table 2 shows the room temperature tensile test results in the longitudinal direction of the ASTM standard specimens of the composition #1 and #2 of the CD and QT conditions.

TABLE 1

| Conditions | | HRC | UTS, ksi | YS, ksi | El, % | RA, % |
|---|---|---|---|---|---|---|
| #1 | QT450 | 55 | 300 | 255 | 8 | 30 |
| | QT1000 | 41 | 185 | 165 | 14 | 52 |
| #2 | CD | 47 | 150 | 110 | 12 | 40 |
| | QT | 57 | 325 | 260 | 7 | 24 |

EXAMPLE 4

Ingot of the New Steel of 6.0" in diameter and 125 lbs weight was air melted, homogenize annealed at 1650° F. for 6 hrs, hot forged at 1850° F. minimum and 2200° F. maximum into bars of 2.5" diameter, and finally, the bars were normalize at 1725° F. for 1 hrs, air cooled and stress relief at 1200° F. for 5 hrs, air cooled. After the normalizing and stress relief, the M-Steel had hardness HRC of 32-33.

The composition of the New Steel of the first embodiments is in percentage weight: C=0.425%, Ni=1.0%, Mn=0.557%, Cu=0.54%, Cr=1.70%, V=0.30%, Si=0.97%, Mo=0.007%, W=0.120%, Ti=0.041%, P=0.012%, S=0.017% and a balance Fe and incidental impurities.

The composition has an critical ideal diameter of 14.16 inch.

ASTM standard tensile and impact specimens were machined in the longitudinal direction at 0.5 radiuses of the bars, and then were heat treated according to Table1:

TABLE 1

| # | Normalizing | Austenizing | Quenching | Tempering |
|---|---|---|---|---|
| 1 | — | 1760° F./1 hr | gas | 450° F./4 hrs |
| 2 | — | 1625° F./1 hr | gas | 450° F./4 hrs |
| 3 | — | 1550° F./1 hr | gas | 450° F./4 hrs |
| 4 | 1625° F./1 hr | 1550° F./1 hr | gas | 450° F./4 hrs |
| 5 | 1625° F./1 hr | 1525° F./1 hr | gas | 450° F./4 hrs |
| 6 | 1625° F./1 hr | — | — | — |

Microstructure of the New steel after the heat treatment #4 comprises: small packets of martensite laths, fine titanium carbides TiC, fine vanadium carbides VC, and retained austenite in weight percent of 3% maximum. The ASTM grain size number is 7 (average grain diameter of 32 microns).

ASTM standard tensile and Charpy v-notch impact tests were conducted. Table2 shows the test results.

TABLE 2

| No | HRC | UTS, ksi | YS, ksi | EL, % | RA, % | CVN, ft-lb |
|---|---|---|---|---|---|---|
| 1 | 56 | 305 | 220 | 8 | 25 | 12 |
| 2 | 54 | 292 | 236 | 9.5 | 26 | 13 |
| 3 | 53 | 278 | 230 | 9 | 35 | 16 |
| 4 | 55 | 300 | 257 | 9 | 32 | 15 |
| 5 | 54 | 286 | 243 | 10 | 35 | 18 |
| 6 | 48 | 244 | 206 | 7 | 30 | — |

The New Steel can be welded by the conventional methods in the annealed condition.

EXAMPLE 5

Automotive application of the New Steel includes transmission and power-train components such as gears, camshafts, axle shafts and others that are usually manufactured from carburized grades such as SAE 8620, 4320, and 9310.

The composition of the New Steel of the first embodiment is in percentage weight: C=0.45%, Ni=1.0%, Mn=0.56%, Cu=0.50%, Cr=1.50%, V=0.28%, Si=1.0%, Mo=0.20%, Ti=0.04%, P=0.011%, S=0.012% and a balance Fe and incidental impurities.

The composition has an ideal diameter of 21.46 inch.

Ingot of 6.5 inch diameter and 160 lb weight was air melted in an induction furnace, and then the ingot were homogenize annealed at 2150° F. for 8 hrs and air cooled. The ingot was heated to 2150° F. and hot rolled until 1850° F. to 2.5 inch diameter bars and air cooled.

One part of the bars was annealed in a furnace at 1600° F. for 6 hrs, then the furnace cooled to 600° F., and finally air cooled (A condition); the bars have hardness of HRC 23. Another part of the bars was normalized at 1750° F. for 1 hr and air cooled, then the bars were subjected to stress relief at 1250° F. for 6 hrs, and finally air cooled (N+SR condition); the bars have hardness of HRC 34.

The bars of the N+SR condition were heat treated by: normalizing at 1750° F. for 1 hr and air cooled; then austenizing at 1650° F. for 1 hr, oil quenching, and tempered at 450° for 3 hrs (QT condition).

Microstructure of the New steel after the heat treatment comprises: small packets of martensite laths, fine titanium carbides (TiC), fine vanadium carbides (VC), and retained austenite in weight percent of 3% maximum. The ASTM grain size number is 7 (average grain diameter of 32 microns).

The ASTM standard tensile and Charpy specimens were machined in the longitudinal direction at 0.5 radios of the heat treated bars. Table1 shows the ASTM standard tensile and impact tests results at room temperature in the A, N+SR, and QT conditions.

TABLE 1

| | HRC | UTS, ksi | YS, ksi | El, % | RA, % | CVN, ft-lb |
|---|---|---|---|---|---|---|
| A | 23 | 110 | 72 | 20 | 50 | — |
| N + SR | 34 | 170 | 128 | 10 | 35 | — |
| QT | 59 | 340 | 270 | 7 | 22 | 10 |

The following method of manufacturing the automotive transmissions and power-trains components such as gears, camshafts, axle shafts and others from the New Steel is proposed in the present invention: hot rolled or hot forged are normalized and stress relieved (N+SR condition); the components are machined from the bars; the components are hardened by normalizing, austenizing, oil quenching, and tempering (QT condition).

In the QT condition, core and surface hardness of the components of the New Steel is HRC 59 vs. surface hardness of HRC 59-61 and core hardness of HRC 40-41 of the carburized, quenched, and tempered SAE 8620, 4320, and 9310 steels.

Utilizing the New Steel allows to reduce the weight of the transmission and power train components by reducing their thickness. For example, projected weight reduction of gears of an automatic transmission of 230 lbs with gears of 130 lbs from carburized SAE 8620, 4320, and 9310 steels will be around 20% or 26 lbs in case of substitution of the carburized steels by the New Steel.

Granted, utilizing the New Steel requires additional investment in the redesigning of the automotive transmissions and power-trains components and the changing some tools. However, benefits of utilizing the New Steel significantly exceed the expenses of its implementation.

From the above, it is apparent that the high hardness, high strength, high impact toughness steel, which is the subject of the invention, is an important development in the art of steel-making. Although only five examples have been described, it is evident that other examples of the new steel can be derived from what is claimed in the presented description without departing from the spirit thereof.

What I claim is new is:

1. A quenched and tempered, fine-grained, with deep hardenability, high strength and low alloy steel comprising weight percent about 0.18% to 0.55% carbon, about 0.001% to 0.05% nitrogen, about 2.0% maximum (excludes 0%) manganese, about 1.5% maximum of copper, about 1.0% maximum (excludes 0%) nickel, about 3.0% maximum (excludes 0%) chromium, one or two elements of molybdenum and tungsten, wherein sum of molybdenum and tungsten about 0.20% maximum (excludes 0%), about 0.30% maximum (excludes 0%) vanadium, one or two elements of titanium and niobium, wherein sum of titanium and niobium about 0.10% maximum (excludes 0%), about 2.0% maximum (excludes 0%) silicon, about 0.0% to 0.20% aluminum, about 0.001% to 0.02% calcium, about 0.035% maximum phosphorus, about 0.04% maximum sulfur, and balance iron and incidental impurities, and wherein said steel having said nickel, molybdenum, tungsten, vanadium, titanium, and niobium in weight percent about 1.0% to 1.60%, and wherein said steel having microstructure comprising small packets of martensite laths, retained austenite, fine titanium carbides or/and fine niobium carbides, and fine vanadium carbides and said steel having ASTM grain size number 6 to 8, and wherein said steel after hot forging or hot rolling and heat treatment having hardness HRC about 54 to 55, ultimate tensile strength about 286 ksi to 300 ksi, yield strength about 243 ksi to 257 ksi, total elongation about 9% to 10%, reduction of area about 32% to 35%, Charpy v-notch impact toughness energy about 15 ft-lb to 18 ft-lb.

2. A quenched and tempered, fine-grained, with deep hardenability, high strength and low alloy steel comprising weight percent about 0.18% to 0.55% carbon, about 0.001% to 0.05% nitrogen, about 2.0% maximum (excludes 0%) manganese, about 1.5% maximum of copper, about 1.0% maximum (excludes 0%) nickel, about 3.0% maximum (excludes 0%) chromium, one or two elements of molybdenum and tungsten, wherein sum of molybdenum and tungsten about 0.20% maximum (excludes 0%), about 0.30% maximum (excludes 0%) vanadium, one or two elements of titanium and niobium, wherein sum of titanium and niobium about 0.10% maximum (excludes 0%), about 2.0% maximum (excludes 0%) silicon, about 0.0% to 0.20% aluminum, about 0.001% to 0.02% calcium, about 0.035% maximum phosphorus, about 0.04% maximum sulfur, and balance iron and incidental impurities, and wherein said steel having said nickel, molybdenum, tungsten, vanadium, titanium, and niobium in weight percent about 1.0% to 1.60%, and wherein said steel having microstructure comprising small packets of martensite laths, retained austenite, fine titanium carbides or/and fine niobium carbides, and fine vanadium carbides and said steel having ASTM grain size number 6 to 8, and wherein said steel having in weight percent about 0.18% to 0.30% carbon being carburized steel with a case depth about 0.04 inch to 0.06 inch, surface hardness HRC about 59 to 62, and a core hardness HRC about 41 to 43, and wherein said steel having in weight percent about 0.30% to 0.45% carbon being deep nitriding steel with case depth about 0.02 inch to 0.03 inch, surface hardness HRC about 61 to 63, and core hardness HRC about 45 to 46.

3. A quenched and tempered, fine-grained, with deep hardenability, high strength and low alloy steel comprising weight percent about 0.18% to 0.55% carbon, about 0.001% to 0.05% nitrogen, about 2.0% maximum (excludes 0%) manganese, about 1.5% maximum of copper, about 1.0% maximum (excludes 0%) nickel, about 3.0% maximum (excludes 0%) chromium, one or two elements of molybdenum and tungsten, wherein sum of molybdenum and tungsten about 0.20% maximum (excludes 0%), about 0.30% maximum (excludes 0%) vanadium, one or two elements of titanium and niobium, wherein sum of titanium and niobium about 0.10% maximum (excludes 0%), about 2.0% maximum (excludes 0%) silicon, about 0.0% to 0.20% aluminum, about 0.001% to 0.02% calcium, about 0.035% maximum phosphorus, about 0.04% maximum sulfur, and balance iron and incidental impurities, and wherein said steel having said nickel, molybdenum, tungsten, vanadium, titanium, and niobium in weight percent about 1.0% to 1.60%, and wherein said steel having microstructure comprising small packets of martensite laths, retained austenite, fine titanium carbides or/and fine niobium carbides, and fine vanadium carbides and said steel having ASTM grain size number 6 to 8, and, wherein automotive transmissions and power-trains components being manufactured from said steel by steps comprising hot rolling or hot forging said steel, annealing or normalizing and stress relieving said steel, machining said components from said steel, hardening said components by normalizing, austenizing, oil quenching, and tempering, and said components having surface and core hardness of about HRC 58 to 59.

* * * * *